US005383235A

United States Patent [19]

Peters

[11] Patent Number: 5,383,235

[45] Date of Patent: Jan. 24, 1995

[54] BENCHPRESS SHIRT

[75] Inventor: Richard E. Peters, Noble, Okla.

[73] Assignee: Ultimate Power Products, Bonita Springs, Fla.

[21] Appl. No.: 133,883

[22] Filed: Oct. 12, 1993

Related U.S. Application Data

[63] Continuation-in-part of Ser. No. 983,035, Nov. 30, 1992, abandoned.

[51] Int. Cl.[6] ..... A41B 1/00

[52] U.S. Cl. ..... 2/115; 2/102; 2/69; 2/243.1; 2/275; 602/60; 602/61; 482/105; 482/148

[58] Field of Search ..... 2/1, 115, 2.1 R, 67, 2/69, 102, 106, 108, 115, 42, 243 B, 275, 2.11, 243.1; 602/60, 61, 19; 482/105, 148

[56] References Cited

U.S. PATENT DOCUMENTS

| | | | |
|---|---|---|---|
| 2,312,609 | 3/1943 | Warshaw | 2/275 |
| 2,338,535 | 1/1944 | Pfleumer | 2/342 |
| 2,723,396 | 11/1955 | Stack | 2/42 |
| 2,760,199 | 8/1956 | Champagne | 2/42 |
| 4,538,614 | 9/1985 | Henderson | 2/1 |
| 5,171,211 | 12/1992 | Deasy, Jr. | 602/60 |

*Primary Examiner*—Clifford D. Crowder
*Assistant Examiner*—Gloria Hale
*Attorney, Agent, or Firm*—William Nitkin

[57] ABSTRACT

A shirt, to be worn on the upper torso of an individual having a waist and waist circumference and a chest and chest circumference, having an upper portion corresponding to the chest area and an upper portion circumference and a lower portion corresponding to the waist area and lower portion circumference wherein the upper portion circumference of the shirt is substantially less than the chest circumference of the wearer and the lower portion circumference is substantially the same as the waist circumference of the wearer. Reinforcement members and panels can be affixed to the shirt to provide additional strength. The shirt can be made of stretchable material and used in weightlifting or for medical rehabilitation.

5 Claims, 4 Drawing Sheets

BENCHPRESS SHIRT

This application is a continuation-in-part of my previous application, Ser. No. 07/983,035, filed Nov. 30, 1992 for a Shirt, now abandoned.

BACKGROUND OF THE INVENTION

FIELD OF THE INVENTION

The shirt of this invention relates to a garment which covers the upper torso and is especially adapted for use by weightlifters and other athletes as well as for use by those requiring upper body medical rehabilitation.

DESCRIPTION OF THE PRIOR ART

Weightlifing shirts of the prior art primarily consist of shirts made of stretchable material and more recently include a garment disclosed in U.S. Pat. No. 4,473,908 to Knecht having forwardly extending sleeves.

In upper body medical rehabilitation the upper body can be taped with trunk bandages or straps having VELCRO brand hook and loop fastening means for the treatment of broken ribs in retraining therapy.

SUMMARY OF THE INVENTION

It is an object of this invention to provide a new garment useful for athletes performing specific physical activities. The same garment can also be utilized for physical rehabilitation during patient recovery from injury or surgery. The shirt of this invention has a tighter fit across the chest than at the waist and is more advantageous to a weightlifter than a shirt that has equal tightness around both the waist and the chest. The prior art, as mentioned above, does utilize garments made of stretchable material for weightlifting purposes, some of which are zipped in the front, but such zippered shirts generally provide similar compression around the user's waist and chest. In contrast, the shirt of this invention provides for two front panels joined by a zipper member which panels meet at the waist, but which front panels are configured such that their sides when unzipped are spaced apart in a V shape being separated from one another at their upper portions. As the zipper is zipped, increasing pressure is felt by the wearer at this chest due to the smaller circumference of the shirt by the stretching of the fabric in relation to the circumference of the wearer's chest which pulls the garment tighter and tighter as the zipper approaches the upper portion of the garment at the neck of the wearer so that the constricting pressure of the garment around the chest area is significantly greater than the constricting pressure of the garment at the wearer's waist.

It is a further object of this invention to provide a shirt to be worn on the upper torso of an individual having a waist and waist circumference and a chest and chest circumference wherein the shirt has an upper portion corresponding to the chest area and an upper portion circumference and a lower portion corresponding to the waist area and lower portion circumference and wherein the upper portion circumference of the shirt is substantially less than the chest circumference of the wearer and the lower portion circumference is substantially the same as the waist circumference of the wearer.

DESCRIPTION OF THE PREFERRED EMBODIMENT(S)

The shirt of this invention is useful for weightlifters performing benchpress exercises. In benchpressing tile weightlifter must lie flat on his back with his head, shoulders and buttocks in contact with the flat bench surface and with his shoes flat on the floor; and this position must be maintained throughout the attempted lift. After receiving the bar with his arms extended upward, the weightlifter lowers the bar to his chest and awaits the signal to commence the lift. After the signal is given, the weightlifter presses the bar upwards to a straight arm length lockout position and holds the bar motionless until the command "rack" is given.

Figure 1:
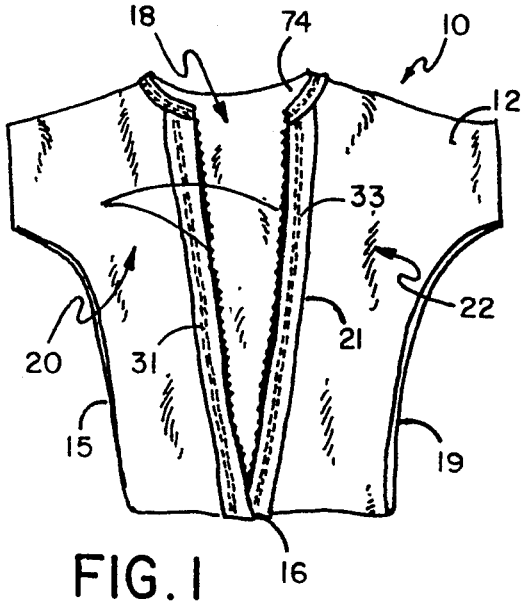
FIG. 1 illustrates a front view of the shirt of this invention in its unzipped state showing the front panels with the engaging parts of the zipper member on each side disposed a greater distance apart from one another at the upper portion of the shirt than at the lower portion of the shirt.
Figure 2:
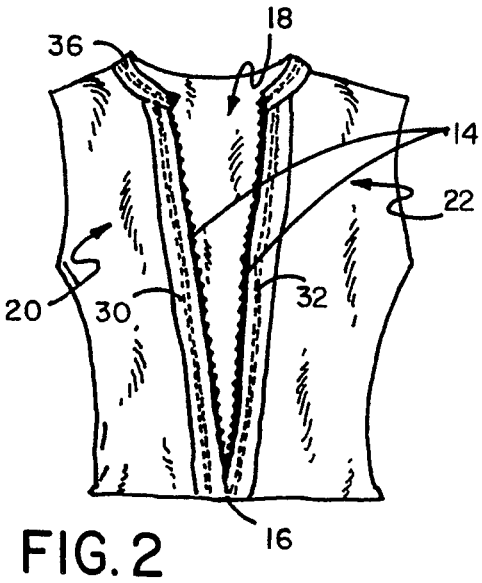
FIG. 2 illustrates a front view of the sleeveless embodiment of the shirt of this invention in its unzipped state.
Figure 3:
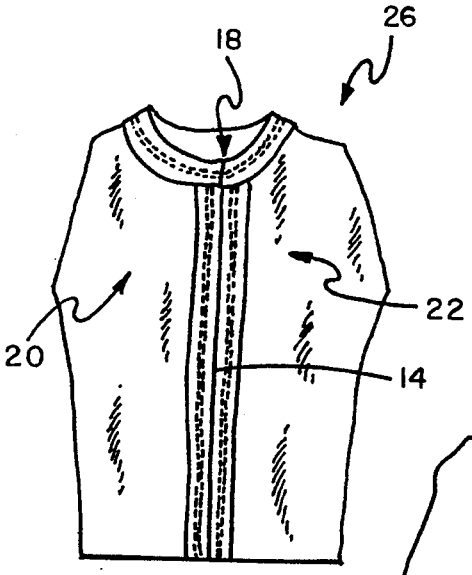
FIG. 3 illustrates the shirt of FIG. 2 having been zipped to apply greater pressure around the upper torso of the user at the upper portion of the garment than at tile lower portion of the garment.
Figure 5:
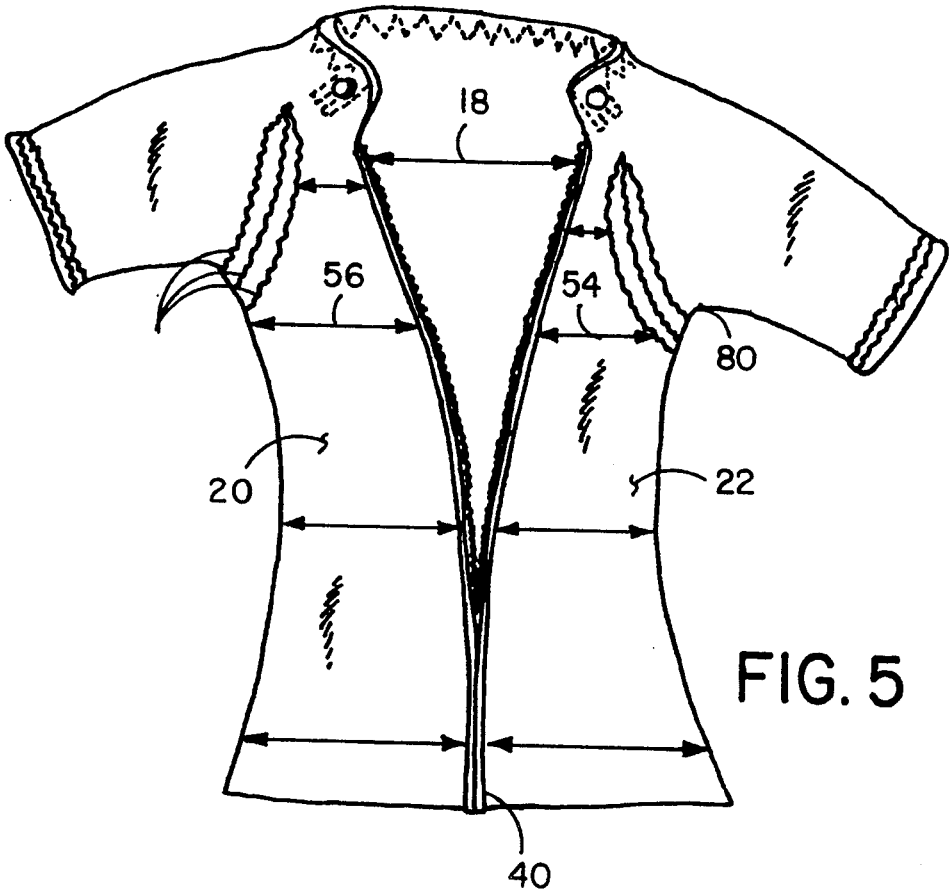
FIG. 5 illustrates a front view of the shirt of this invention having a tapered body portion and sleeve reinforcements.
Figure 6:
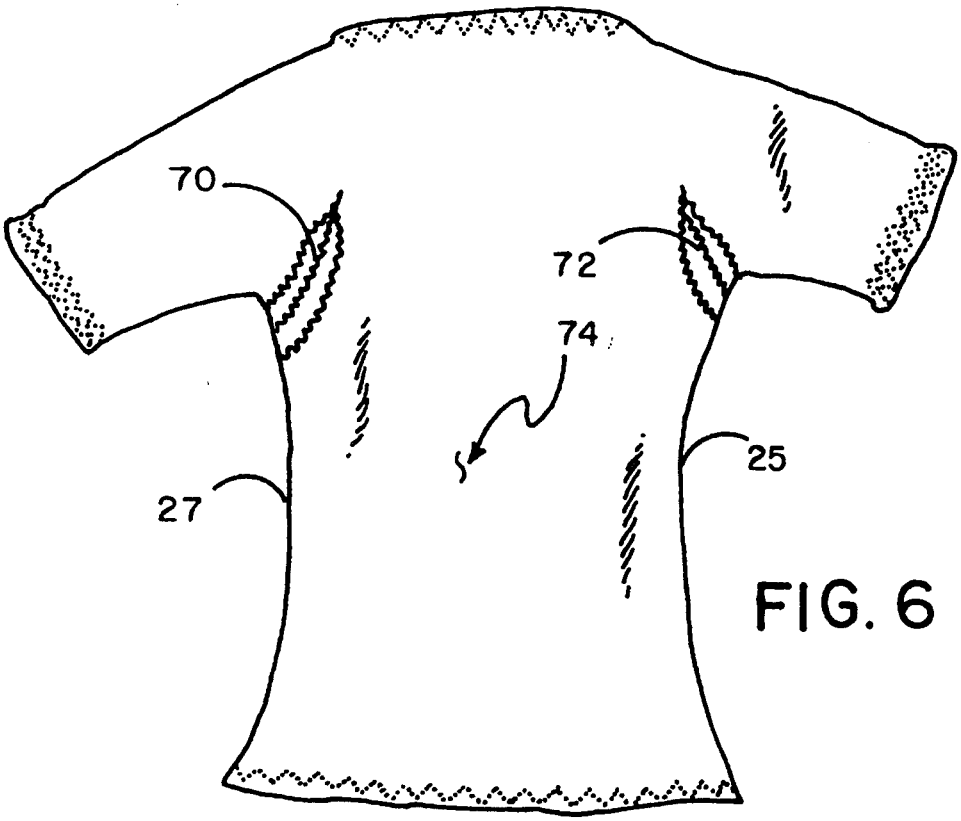
FIG. 6 illustrates a rear view of the shirt of FIG. 5.

FIG. 1 illustrates shirt 10 of this invention which can have sleeves 12 or which can be sleeveless as seen in FIG. 2. The shirt of this invention can be made in one piece so that the only seams present are at the sides extending up under the sleeves. Seen in FIG. 1 are first and second side portions 15 and 17 of first front panel 20, first and second side portions 19 and 21 of second front panel 22, and back portion 74 having first and second side portions 25 and 27 as seen in FIG. 6. In a preferred embodiment first side portions 25 and 15 are joined in a side seam and second side portions 19 and 27 are joined in a seam. Because the front panels and back portion are made from a single piece of fabric, there are no shoulder seams in this embodiment, but shoulder seams can be incorporated into the shirt design if desired. Joined to second side portions 17 and 21 of front panels 20 and 22 are first zipper member 31 and second zipper member 33, forming zipper 14 shown engaged in FIG. 3. When the shirt is in its non-use, unzipped mode, first and second front panels 20 and 22 with attached first and second zipper members 31 and 33 of zipper 14 are spaced apart a distance 18 at the upper portion of the shirt, forming a V-shaped opening. The front panels and back portion of the shirt are configured so that their circumference when zipped up at the chest level at the upper portion of the shirt is substantially less than the chest circumference of the wearer while the circumference of the shirt at its waist-level lower portion is very close to the circumference of the waist of the wearer. This configuration is accomplished by making the upper portions of the front panels narrower, for example, across distances 54 and 56, as seen in FIG. 5, than would normally be required to fit the chest of the user. This narrow cut of the upper portions of the front panels causes them to be spaced apart from one another when wearing the shirt before zipping it up. When shirt 10 is zipped, as seen in FIG. 3, first and second front panels 20 and 22 of the chest portion of the shirt are pulled together at the upper portion of the shirt so that there is significantly more pressure exerted by the garment across the chest portion of the wearer as the material of the shirt must stretch more at the upper chest portion of the shirt to close across distance 18 than at the waist portion of the shirt. When the shirt of this invention in worn by a weightlifter performing a bench-press and he lowers the bar to his chest, the extreme tightness of the shirt compressing inwards helps the weightlifter push the bar off his chest to the lockout position. The stretchable material of the shirt, even when tightly compressing the wearer's chest when the shirt is zipped up, is stretched further as the lifter lowers the bar to his chest. The fabric is such that when stretched it contracts by its own resiliency around the wearer's chest, arm and shoulder muscles and as the bar is being pushed upward, this contraction of the fabric adds to the upward force in lifting the bar as described below. First and second front panels 20 and 22 are sufficiently wide at the waist of the wearer for zipper 14 to be joined without exerting any significant compression at zipper junction 16. First and second front panels 20 and 22 at their upper portions have insufficient width to cause the garment to totally surround the chest of the wearer in an unzipped state and are thus spread apart from one another, for example, a distance 18 typically in the range of 5"–8"".

Figure 4:
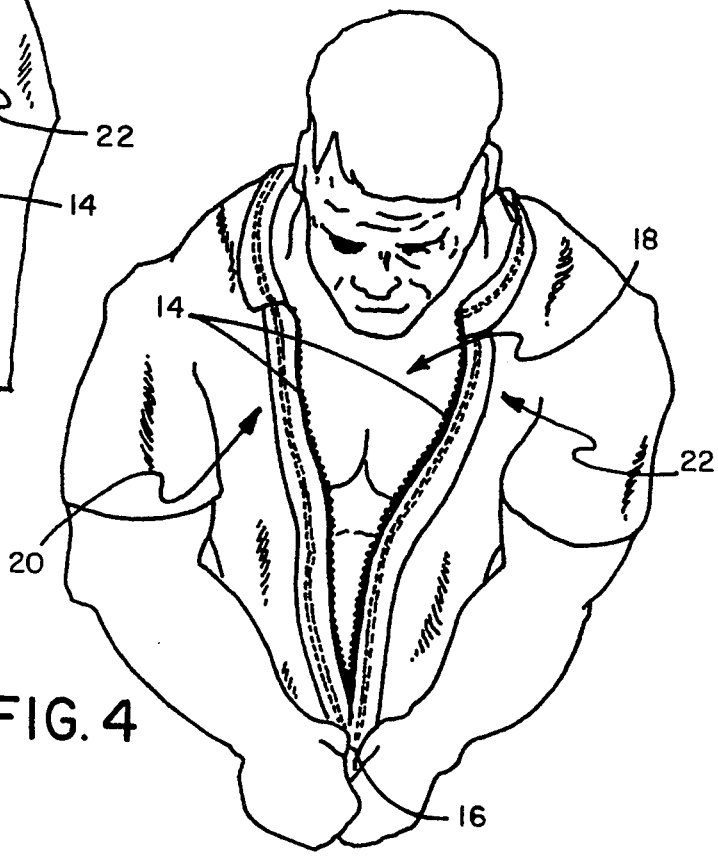
FIG. 4 illustrates an individual about to zip the shirt of FIG. 1.

FIG. 4 illustrates an individual about to zip the shirt of this invention. First and second front panels 20 and 22 are spaced apart a distance 18 from one another at the upper portion of the shirt but are joined together at zipper junction 16 at the waist of the wearer at the lower portion of the shirt without significant stretching of the material of the shirt, forming a V-shaped opening. In order to fully zip up the shirt after initially engaging the zipper at zipper junction 16, the wearer must move his shoulders forward. After starting the zipper, the wearer can cross his arms in front of himself, pulling his shoulders and pectorals together while starting to pull up on the zipper as seen in FIG. 4. When the shirt is fully zipped, the wearer is unable to relax his chest muscles because of the contraction of the material across his chest. After the shirt is fully zipped, the wearer can then move his shoulders back. Other methods of putting on the shirt of this invention can be utilized such as having the wearer cross his arms in front of himself which action draws the wearer's shoulders into a forward position. A second person can then assist in zipping up the shirt. Without the wearer putting his arms in a position that pulls his shoulders forward to constrict the chest area, it would be difficult to zip up this shirt due to the considerable pressure around the upper torso of the wearer caused by the stretched material, making it difficult to bring the upper portion of the panels of the shirt together.

The garment of this invention can be made of a stretchable, polyester material such as Milliken fabric No. 433,796 which weighs 11.25 oz per linear yard and has a strength of 90 lb psi. In a preferred embodiment a heavy duty zipper such as a Bayside Marine Zipper can be used. The type of zipper can be a double-locking zipper which prevents undesirable unzipping, especially when the wearer is weight-lifting and the shirt is under full stress. The zipper can be made of high-strength plastic. Metal zippers have been found to be undesirable as they are attacked by body oils and acids which render them dysfunctional over time. In the future metal zippers may be developed which are not susceptible to body oils and acids and if so, such metal zippers could be used in the shirt of this invention. The shirt can be made in one piece or can be fashioned from a multi-piece pattern. The one-piece embodiment has the advantage of reducing the number of seams in the garment which seams offer potential points of weakness. The material should be sewn with a round-tip needle as it has been found that a pointed tip needle will cut the fibers of the material and produce weak points where the material is stitched.

The sleeveless garment 10 of FIG. 2 can be tapered at the side portions to further increase the tightness across the upper torso. In its unzipped state, the garment's first and second front panels form a V-shaped front opening, as seen in FIG. 2, with the widest portion of the V-shaped opening being at the upper portion of the shirt at the chest and neck area of the shirt but meeting together at the waist area. When worn in its unzipped mode, the shirt will fit loosely, but when the shirt is zipped up, the shirt will become progressively tighter as the zipper is zipped. The zipping action pulls the upper portions of first and second front panels, for example, portions 54 and 56 seem in FIG. 5 together so that the fabric must stretch more around the chest area of the wearer as the unstretched material of the shirt across the upper portion of the garment has a much narrower circumference than the actual circumference of the wearer's chest. This pulling together of the front panels when zipping the shirt creates the substantial tightness around the wearer's chest due to the narrower circumference of the combined front panel portions and back portion of the shirt when compared to the chest circumference of the wearer. The tightest portion of the shirt when worn is adapted to be across the chest of the wearer.

FIGS. 5 and 6 illustrate a reinforced embodiment of the shirt of this invention where the fabric is cut in a semi-circle under the sleeve and restitched to form first and second sleeve seams 70 and 72 as seen in FIG. 6. To reinfore each of these sleeve seams a reinforcement member, such as reinforcement member 76 seen in FIG. 7 which corresponds in shape to the circular cut, can be sewn to the interior side of the shirt over first and second sleeve seams 70 and 72. The reinforcement member can be made of fabric similar to the fabric of the shirt. In the rear view of FIG. 6 first and second sleeve seams 70 and 72 are seen extending along back portion 74 with reinforcement stitching 78 utilized across sleeve seams 70 and 72 as well as around the length of each reinforcement member. The reinforcement members help to reinforce areas of high stress on the material of the shirt.

Figure 7:
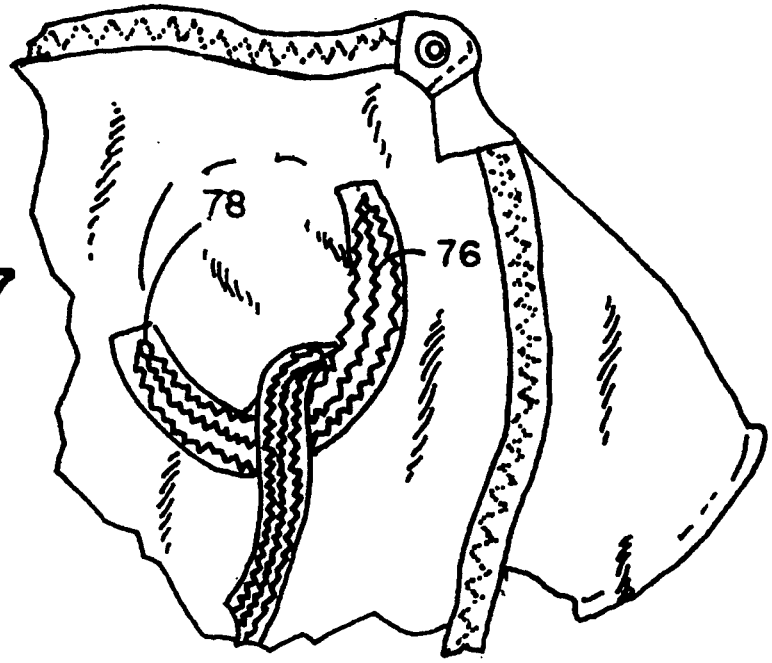
FIG. 7 illustrates a perspective view of the interior of one of the sleeves showing a sleeve reinforcement member.

FIG. 7 illustrates an interior view of a sleeve showing reinforcement member 76 which is held in place by reinforcement stitching 78.

In its fully zipped, worn position the shirt is extremely tight across the wearer's chest which compression is especially useful for weightlifters, as discussed above, as well as for patients where application of increased pressure around the chest area is a desirable medical treatment. The garment of this invention can be worn as safety equipment for weightlifters performing benchpress exercises and for other athletes in general. The use of the garment of this invention has been found not to retard circulation or pinch under the arms, and it does not retard the fully locking out of elbows in a bench press exercise. As the weightlifter wearing the shirt of this invention holds a bar with weights thereon and lowers the bar toward his chest, his chest will normally expand. The garment becomes even tighter as-the chest expands, and much constricting pressure from the garment is transferred to help constrict the wearer's muscles which action assists with the bar lift. When the individual lifts the weight bars to the full extension position with the arms extended and elbows locked, the chest is not fully expanded and the garment thus becomes less tight. Similarly, an individual wearing the garment of this invention for medical purposes is benefitted by the garment fitting tightly across the chest and applying pressure around the upper torso for the treatment of cracked or broken ribs. Wearing the garment of this invention will also tend to restrict certain movements that could be harmful for a recovering patient. The patient wearing the garment of this invention can adjust the pressure of the garment by partially zipping or partially unzipping the garment and then locking the zipper so that the zipper will not move further in either direction.

Figure 8:
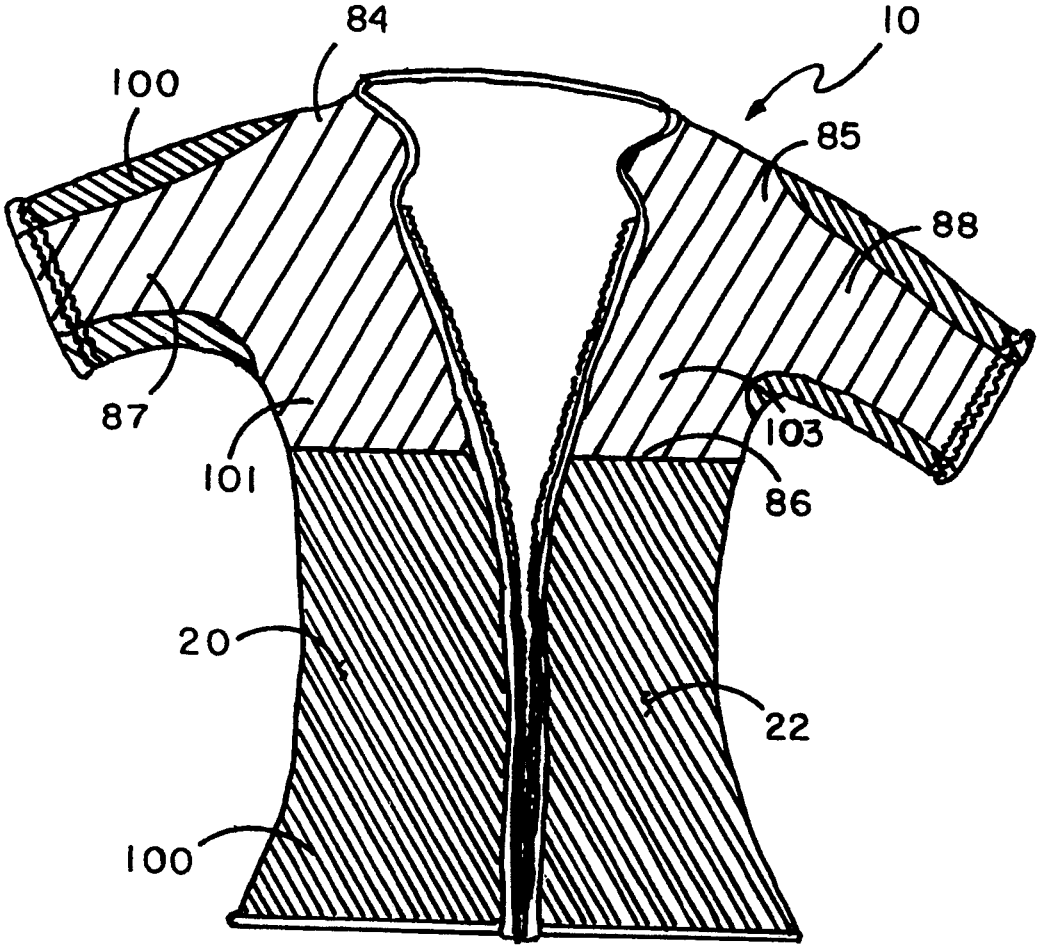
FIG. 8 illustrates a front view of the shirt of this invention having a reinforcement layer of fabric on its upper portion.
Figure 9:
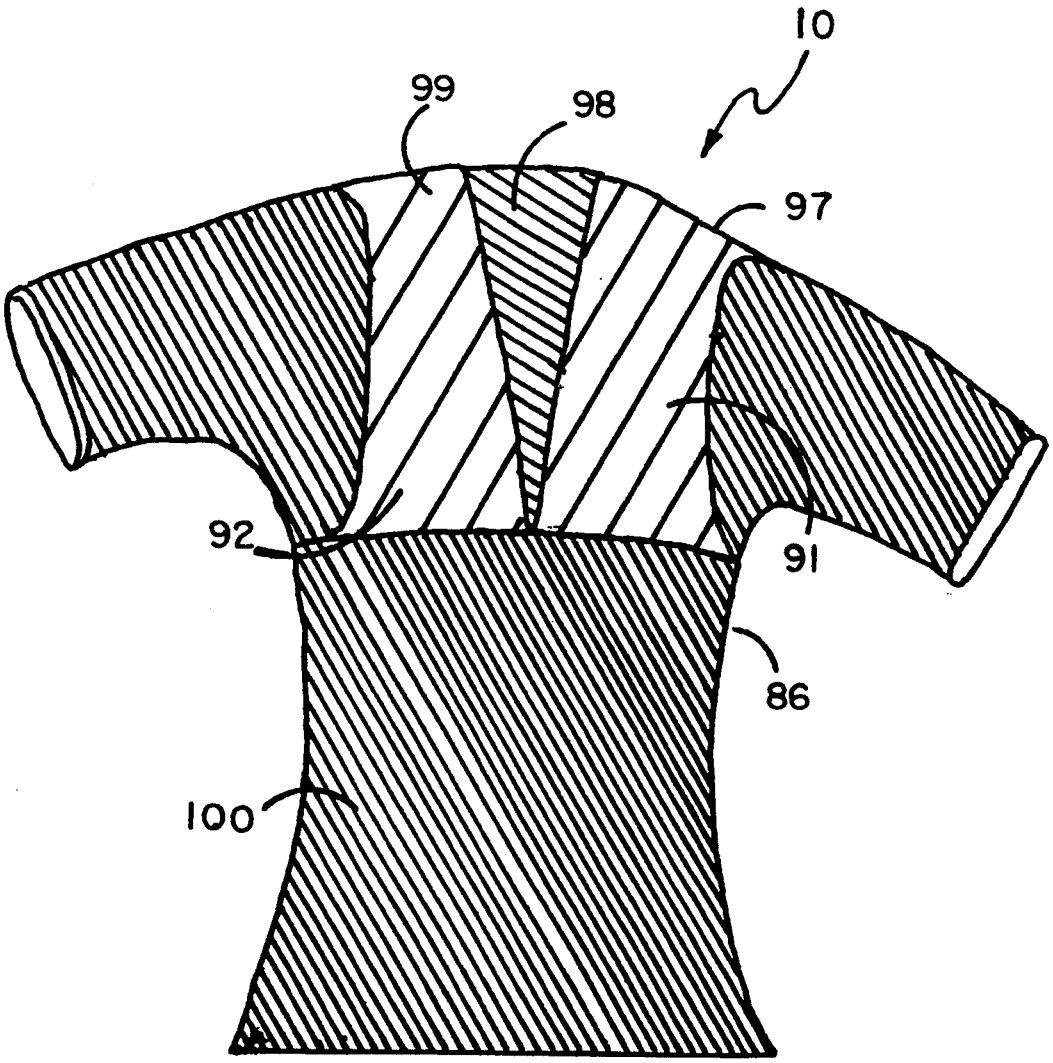
FIG. 9 illustrates a rear view of the shirt of FIG. 8.

FIG. 8 illustrates a front view of shirt 10 of this invention made of fabric 100 and shows first and second reinforcement panels 84 and 85 placed over fabric 100 which panels are affixed to fabric 100 of the shirt by reinforcement stitching along the panels' edges. First and second reinforcement panels 84 and 85 extend respectively over the upper portions of first and second front panels 20 and 22 forming first and second reinforcement front panels 101 and 103 to position 86 located below the sleeve members. First and second extensions 87 and 88 of first and second reinforcement panels 84 and 85 extend along the front portion of each sleeve member. In FIG. 9 can be seen first and second reinforcement panels 84 and 85 which extend respectively over first and second shoulder portions 97 and 99 to form first and second reinforcement back panels 91 and 92 on the rear of the garment which first and Second reinforcement back panels 91 and 92 are separated from each other by a V-shaped space 98 through which space fabric 100 of the shirt can be seen. First and second reinforcement back panels 91 and 92 extend down to the same position 86 as seen in FIG. 8. The reinforcement panels can be made of the same fabric as the shirt of FIG. 1 or of other suitable fabric. First and second reinforcement panels 84 and 85 act to provide further strength to the shirt when under strain such as when the wearer of the shirt is benchpressing.

Although the present invention has been described with reference to particular embodiments, it will be apparent to those skilled in the art that variations and modifications can be substituted therefor without departing from the principles and spirit of the invention.

I claim:

1. A shirt to be worn on the upper torso of an individual having a waist and a waist circumference and a chest and a chest circumference, comprising:

an upper portion corresponding to said chest area of said wearer having an upper portion circumference;

a lower portion corresponding to said waist area of said wearer having a lower portion circumference;

wherein said upper portion circumference of said shirt is substantially less than said chest circumference of said wearer, and said lower portion circumference of said shirt is substantially the same as said waist circumference of said wearer;

a front portion having first and second front panels, each of said first and second front panels having an upper portion having a width and a lower portion having a width;

a back portion having first and second sides and an upper portion having a width and a lower portion having a width, said back and front portions of said shirt at their upper portions having an upper portion circumference and said lower portions of said front and back portions having a lower circumference;

said first and second front panels each having first and second sides, said first sides of said first and second front panels attached, respectively, to the first and second sides of said back portion of said shirt, and said second sides of said first and second front panels being centrally and vertically disposed on the front portion of said shirt;

first and second shoulder portions positioned, respectively, between said first and second front panels and said back portion;

a zipper having first and second engaging portions attached, respectively, to said second sides of said first and second front panels, said zipper in its unzipped mode coming together at said lower portion of said shirt to form a zipper junction, the combined width of said front panels at said lower portion being substantially the same as the width of said back portion at said lower portion and said first and second engaging portions of said zipper being separated from each other at said upper portion of said shirt when unzipped by a distance defined between said first and second front panels at said upper portion of said shirt, said distance at a particular point along said vertically disposed second sides of said first and second front panels determined by the width of said back portion at said upper portion being greater than the combined width of said first and second front panels at their upper portion by a distance defined between said first and second front panels in an unzipped mode causing a difference between the shirt's circumference and the wearer's chest at said point at the upper portion circumference of said shirt in its unzipped mode said shirt in its use mode, being zipped, pulling said upper portions of said first and second front panels together across said distance between said first and second front panels to exert greater pressure around the chest of the wearer at said upper portion of said shirt than at the wearer's waist at said lower portion of said shirt.

2. The shirt of claim 1 wherein said distance between said first and second front panels at their upper portion is approximately 5–8 inches such that the combined width of said first and second front panels is approximately 5–8 inches less than the width of said back portion at said upper portion of said shirt.

3. The shirt of claim 2, said shirt having an inside, said shirt further including:

first and second sleeve members, each having a front portion forming first and second front portions;

first and second cuts defined, respectively, under said first and second sleeve members;

first and second reinforcement members positioned, respectively, over said first and second cuts on said inside of said shirt; and reinforcement stitching disposed through said reinforcement members and said first and second sleeve members joining said first and second reinforcement members respectively to said first and second sleeve members.

4. The shirt of claim 3 further including:

first and second reinforcement panels each panel having a perimeter and an edge disposed around its perimeter, said first and second reinforcement panels respectively extending over said upper portions of said first and second front panels to form first and second reinforcement front panels, across said first and second shoulder portions, and over said upper portion of said back portion to form first and second reinforcement back panels, said first and second reinforcement front panels and said first and second reinforcement back panels extending down said shirt to a position below said first and second sleeve members;

first and second extension members, each extending respectively from said first and second reinforcement front panels, said first and second extension members extending respectively over said first and second sleeve front portions; and reinforcement stitching disposed through said edges of said first and second reinforcement panels and said shirt, said stitching joining said first and second reinforcement panels to said shirt.

5. The shirt of claim 4 further including a V-shaped space defined between said first and second reinforcement back panels.

* * * * *